United States Patent [19]

Ahn

[11] Patent Number: 5,054,639

[45] Date of Patent: Oct. 8, 1991

[54] FLOATING STRAW FOR BEVERAGE CANS

[75] Inventor: Si Y. Ahn, 61-43 Springfield Blvd., Oakland Gardens, N.Y. 11364

[73] Assignee: Si Y. Ahn, Bayside, N.Y.

[21] Appl. No.: 573,633

[22] Filed: Aug. 27, 1990

[51] Int. Cl.[5] ..... A47G 19/22

[52] U.S. Cl. ..... 220/90.2

[58] Field of Search ..... 220/90.2, 90.4, 90.6; 215/1 A; 229/103.1

[56] References Cited

U.S. PATENT DOCUMENTS

| | | | |
|---|---|---|---|
| 3,656,654 | 4/1972 | Brinkley, III | 220/90.2 |
| 3,980,210 | 9/1976 | Klingerman | 229/103.1 |
| 4,537,324 | 8/1985 | Wang | 220/90.2 |
| 4,690,294 | 9/1987 | Jones | 220/90.2 |
| 4,826,034 | 5/1989 | Forbes | 220/90.2 |
| 4,877,148 | 10/1989 | Larson et al. | 220/90.2 |
| 4,892,187 | 1/1990 | Stein | 220/90.2 |
| 4,930,652 | 5/1990 | Murphy et al. | 220/90.2 |

*Primary Examiner*—Stephen Marcus
*Assistant Examiner*—S. Castellano

[57] ABSTRACT

A drinking straw contained in a beverage can having a flexible portion (3), a floating ball (4) and a ring (5). The can has a straw holder (7) and a straw guide (22) spot welded on the inside of it. When the pull tab is opened, the straw guide detaches the straw from the holder and guides it to the opening slot. The straw comes up to an ideal drinking position immediately after the tab is opened and the user does not have to use his/her fingers to hold the straw. This convenient and safe invention will make any drinking experience a healthy and pleasurable one.

1 Claim, 3 Drawing Sheets

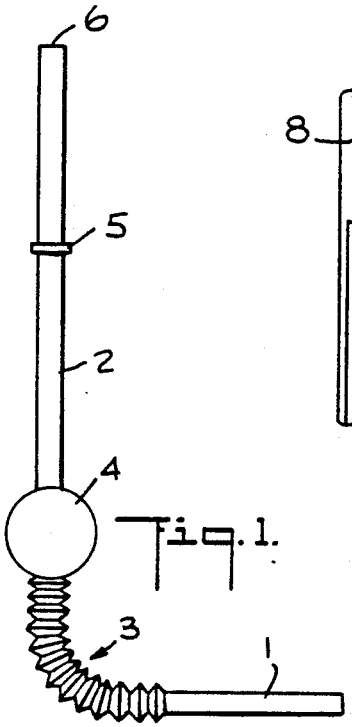
Fig. 1.
Fig. 5.
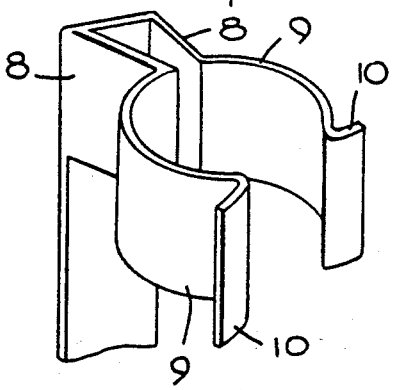
Fig. 2.
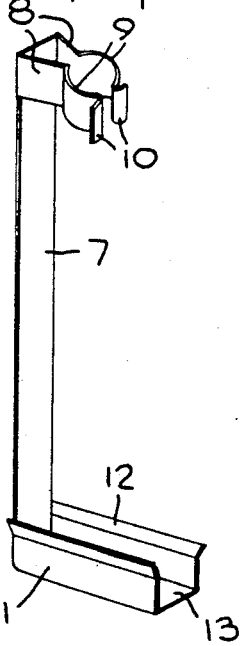
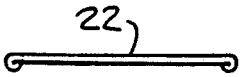
Fig. 14.
Fig. 8.
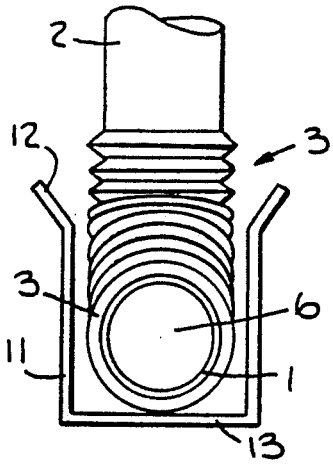
Fig. 12.
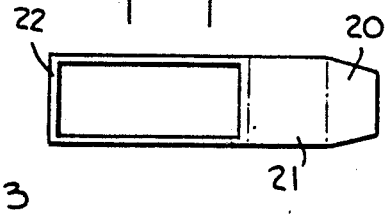
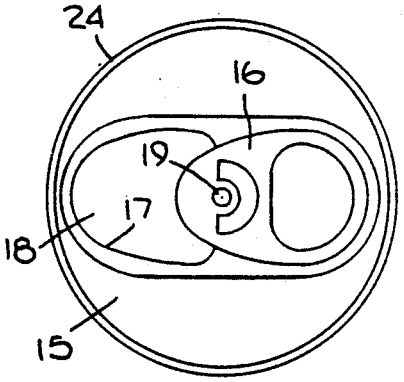
Fig. 13A.
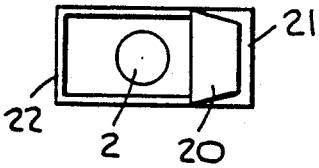
Fig. 9.
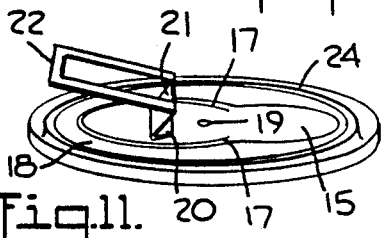
Fig. 11.
Fig. 10.
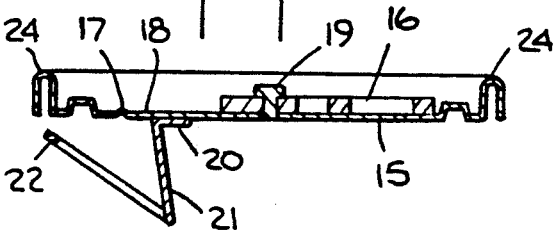
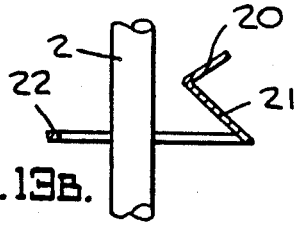
Fig. 13B.

FLOATING STRAW FOR BEVERAGE CANS

BACKGROUND—FIELD OF INVENTION

This invention relates to beverage drinking, specifically to drinking through a floating straw already contained in the beverage can.

BACKGROUND—DESCRIPTION OF PRIOR ART

Beverage cans have been used for many decades, however little improvement was done to make them more convenient to consumers. Most people drink beverages in cans using straws, but beverages do not come with them requiring consumers to ask for them or many times buy them separately which is a tremendous inconvenience and time consuming for the consumers. Furthermore, since the straws come in individual wraps the consumer is required to use his/her fingers to tear off the protective wrap and insert it in the can. This process of touching the straw with fingers can create an unhealthy situation if one does not have a properly washed hand.

Therefore, many inventions were conceived and patented in this field:

| U.S. Pat. No. | Patentee | Issue Date |
|---|---|---|
| 4,109,817 | Payne & Lancaster | 8/29/78 |
| 3,656,654 | Brinkley | 4/18/72 |
| 4,228,356 | Lemelson | 10/07/80 |
| 4,228,913 | Mack | 10/21/80 |
| 4,305,521 | Komatsuta & Onodera | 12/15/81 |
| 4,356,927 | Cooper & Clark | 11/02/82 |

Larry E. Payne and Kenneth D. Lancaster, Jr. U.S. Pat. No. 4,109,817 discloses a telescopic straw contained in a can. Their invention was designed to be used in cans having a pull tab closure that separates completely from the can itself. Today's beverage cans do not have closures that separate completely from the can and in addition, the straw is pulled manually as they mentioned in their summary of invention which creates the possibilities of unhealthy conditions.

William J. Brinkley, III U.S. Pat. No. 3,656,654 discloses a straw in a can. The straw is attached to a pin that is a projection of the tear out strip in the inside of the can. This invention presents inconveniences because a person drinking it will have to pull out the straw from the pin with his fingers in order to use it, creating another unhealthy situation.

Jerome H. Lemelson U.S. Pat. No. 4,226,356 discloses a can having a pull tab that tears out and separates from the can, and it is not being used for beverages anymore. Furthermore, in the assembly line the straw should be inserted in the can before the beverage is poured. The liquid is poured in the can in a matter of seconds, and the pressure of the liquid while being poured would cause the straw to move from its intended position (since the straw is not tightly held) presenting serious problems in the process of manufacturing it.

Alberto Mack and Charing Mack U.S. Pat. No. 4,228,913 discloses another can containing a straw. Their invention was also designed for a can having a removable pull tab closure which is not in use anymore. And besides, his invention does not give a satisfying explanation. Referring to his drawings, once the straw guide is attached in the can, it is impossible to insert the straw in it since the straw retaining portions 21 and 23 are not the same size.

Hiroshi Komatsuta and Shigesato Onodera U.S. Pat. No. 4,305,521 discloses a container with a straw in it. Their invention was also designed for cans with removable pull tab closures which are not being used for beverages anymore. Furthermore, his straw is attached to the top wall by a pin shaped projection without any other support. During transportation, the pin shaped projection is not enough to secure the straw because if can is shaken the straw will move like a pendulum and possibly detach from the pin.

In addition, if their pin shaped projection separates from the straw when the tab is opened, it means that the straw is somewhat loose on the pin. Therefore, at the assembly line after the beverage is poured in the can the top will come with the straw hanging from the pin. While moving, the straw might as well detach from the pin, making it commercially not viable.

George W. Cooper and Gloria A. Clark U.S. Pat. No. 4,356,927 discloses a pop-up straw for beverage cans that is not very convincing. Their invention discloses two designs. The first one will not work because it requires a change in the shape of the bottom of the can. The round concave shape of the bottom of the can was made that way to take the pressure caused by the carbonation of the beverage. Modifying it would make the can more vulnerable to shocks caused during normal transportation.

Their second design discloses a straw that floats due to the air trapped in the folded areas of the flexible portion of it. The air trapped is so small that it will not raise the straw fast enough to satisfy a thirsty drinker. Furthermore, if the level of the liquid decreases the straw will not come up at all.

All the patents listed above contain straws in containers, but most of them present the possibility of unhealthy situations since some inventions require the use of fingers to hold the straw. In today's society, because of the awareness of AIDS and other contagious diseases people generally are frightened by the idea of having bacterias in their food. And this is also true for holding the straw with fingers that sometimes carry harmful bacterias that cannot be seen with the naked eye.

Furthermore, all the patents listed above were designed for cans having removable pull tab closures which were used in the past, not anymore. Today's beverage cans have a tab that does not separate from the can, instead it is bent down into the drinking slot and stays attached to the top of the can by a portion that does not tear. Therefore, the designs of patents listed above cannot be used in today's cans.

The design of my invention fits exactly in beverage cans used nowadays. My invention is so safe and reliable that even a small child will be able to appreciate its benefits. The invention consists of a straw with a floating ball attached to it and a flexible portion. When the tab is opened, the straw which was under the lid waiting to come up will pop-up immediately to an ideal drinking position, giving consumers immediate satisfaction and pleasure from a simple drinking experience.

OBJECTS AND ADVANTAGES

Accordingly, besides the objects and advantages of the floating straw described in my above invention, several other objects and advantages are:

(a) To provide a beverage can containing a straw that is virtually hands-free. The consumer will not have to use his/her fingers in any moment making it the safest and healthiest way to drink any beverage.

(b) To provide a floating straw that comes up accurately to an ideal drinking position immediately after the pull tab is opened.

(c) To provide a straw holder that will securely hold the straw in place even during impacts.

(d) To provide a straw guide that guides the straw accurately to the opening slot.

Further objects and advantages will become apparent from a consideration of the ensuing description and drawings.

DRAWING FIGURES

In the drawings, some figures have the same number but different alphabetic suffixes.

FIG. 1 is a perspective view of the straw containing a flexible portion, a floating ball and a ring.

FIG. 2 is a perspective view of the straw holder.

FIG. 3 is a perspective view of the beverage can.

FIG. 4 is a cross sectional view of the invention without the straw.

FIG. 5 is a perspective view of the top portion of the straw holder in FIG. 2.

FIG. 6 is a cross sectional view of the can containing the straw and the straw holder.

FIG. 7 is a cross sectional view of the can facing the straw and its holder.

FIG. 8 is an enlarged view of the lower portion of the straw in the straw holder.

FIG. 9 is a view of the top of the can.

FIG. 10 is cross sectional view of the top of the can in FIG. 9.

FIG. 11 is a perspective view of the top of the can in FIG. 9 but upside down, showing its bottom part.

FIG. 12 is a view of the unfolded straw guide with dotted lines where it should be folded.

FIG. 13A is a top view of the straw guide with the straw in its hole.

FIG. 13B is a sectional view of FIG. 13A.

FIG. 14 is a sectional view of the lower portion of the straw guide with rolled ends.

FIG. 15 is a cross sectional view of the invention which is the final product that consumers would buy.

FIG. 16 is cross sectional view of the invention in FIG. 15 with the tab half opened.

FIG. 17 is a cross sectional view of the can with the straw in drinking position.

FIG. 18 is a cross sectional view of the can with the straw straightened to suck the beverage when the level of liquid goes down.

REFERENCE NUMERALS IN DRAWINGS 1. lower portion of straw
2. upper portion of straw
3. flexible portion of straw
4. floating ball or buoy
5. ring
6. inside of straw
7. straw holder
8. arm
9. hand
10. hand flaps
11. eaves shaped straw case
12. straw case's flaps
13. straw case's bottom
14. can
15. top wall of can
16. pull tab
17. scored line
18. tab
19. rivet
20. portion of straw guide that is spot welded
21. middle portion of straw guide
22. straw guide
23. opening slot
24. chime
36. surface of liquid
37. liquid or beverage

DESCRIPTION OF FIGURES

FIG. 5 discloses the top portion of the straw holder 7. This portion has an arm 8 and ends with a hand shaped portion 9 that will hold the straw in place. Hand 9 is bent outwards (10) to facilitate the grabbing and release of the straw by portion 9. Both arms 8 are bent inwards to grab the straw more tightly. Now referring to FIG. 2 we can see the whole straw holder. The bottom portion of it 11 looks like an eaves and it has flaps 12 on both sides to facilitate the entering of the straw. Like the can, the straw holder 7 is made of alluminum and is glued or spot welded on the inside of the can as FIG. 4 shows.

FIG. 1 discloses the straw with a flexible portion 3, a floating ball 4 and a small ring 5. The floating ball 4 has a hole in the middle with the same diameter as the straw. Portion 2 of the straw is inserted in the floating ball 4 until it reaches the flexible portion 3, then a small ring 5 is put around the middle of portion 2 in a way it does not move.

Figure 3:
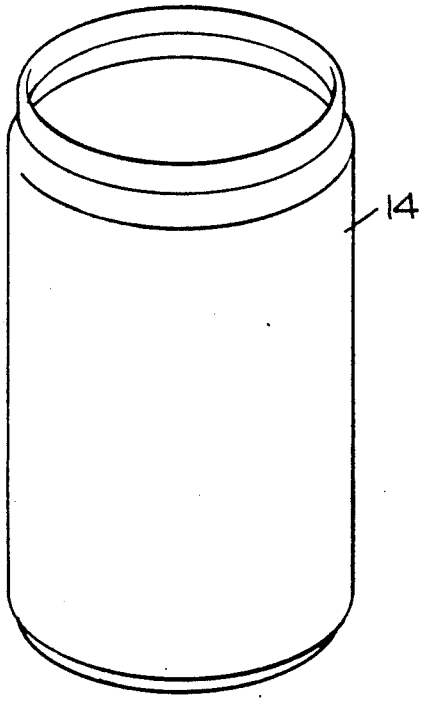
Figure 4:
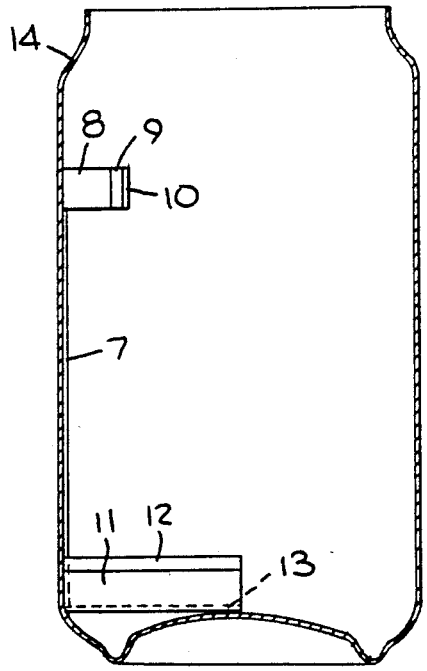
Figure 6:
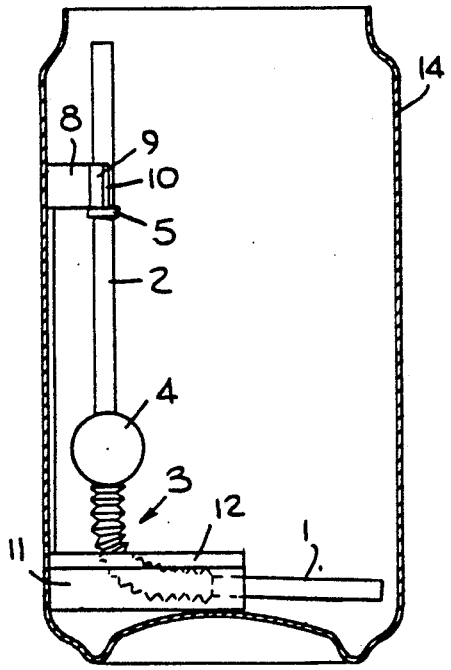
FIG. 6 discloses the straw in its position in the can. After the straw holder is spot welded in the inside of the can as in FIG. 4, the straw is bent in the flexible portion 3 and part of it is put inside the straw case 11. Portion 2 of the straw is tightly inserted in the hand 9, but ring 5 has to go right under the hand 9 because the ring holds the straw from moving up during impacts or transportation.
Figure 7:
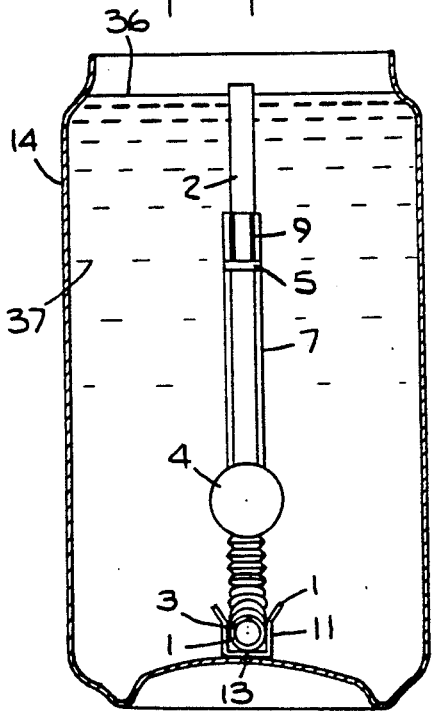

In the bottling company, the beverage is poured in the can in a matter of seconds causing tremendous pressure in the can. However, since the straw is so tightly secured by portions 11 (FIG. 8) and 9, it will not move when the beverage is poured as FIG. 7 shows.

The straw guide is a rectangular piece of alluminum sheet and has a rectangular hole in one side. The purpose of the hole is to insert the straw in it as FIGS. 13A and 13B show and guide it to the opening slot when the can is opened. The ends of the straw guide are rolled to make the straw slip easily through it. The straw guide is folded at the dotted lines (FIG. 12) in a way it would look like the straw guide in FIG. 10. Portion 20 of the straw guide is spot welded underneath the tab 18 as FIG. 10 shows.

Figure 15:
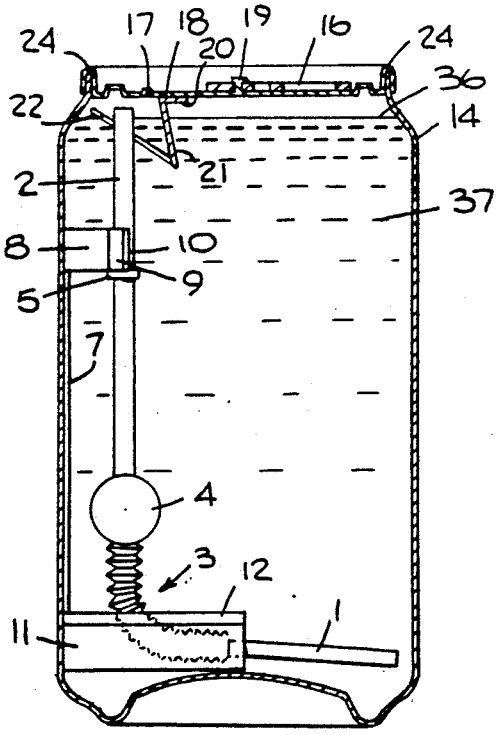

The top of the can is put after the straw holder and the straw are put in place and the beverage is already poured. As the chime 24 touches the can, the hole of the straw guide will surround the top portion of the straw as in FIG. 15.

Figure 16:
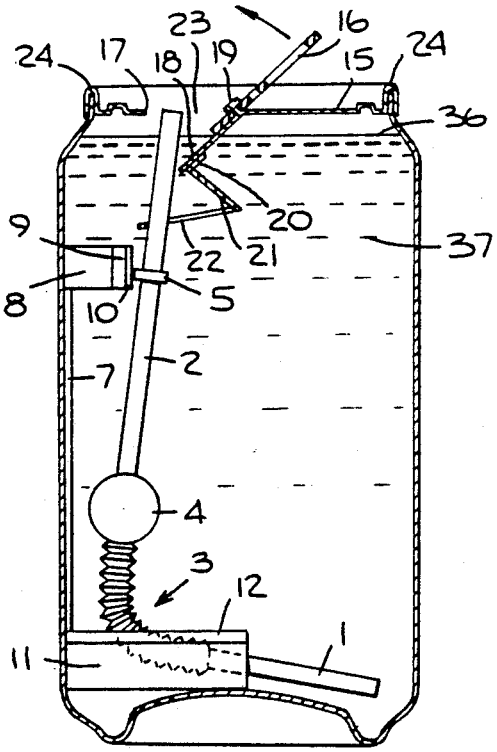

FIG. 16 discloses exactly what happens when the pull tab 16 is pulled. When pull tab 16 is pulled up, tab 18 will be pushed into the can and since the straw guide is attached underneath the tab 18 it will move together making the straw detach from hand 9 and guiding it to the opening slot 23. As the pull tab 16 is pulled up a little more the straw detaches completely from hand 9 coming up immediately to an ideal drinking position because of the floating ball, as we can see in FIG. 17.

Figure 18:
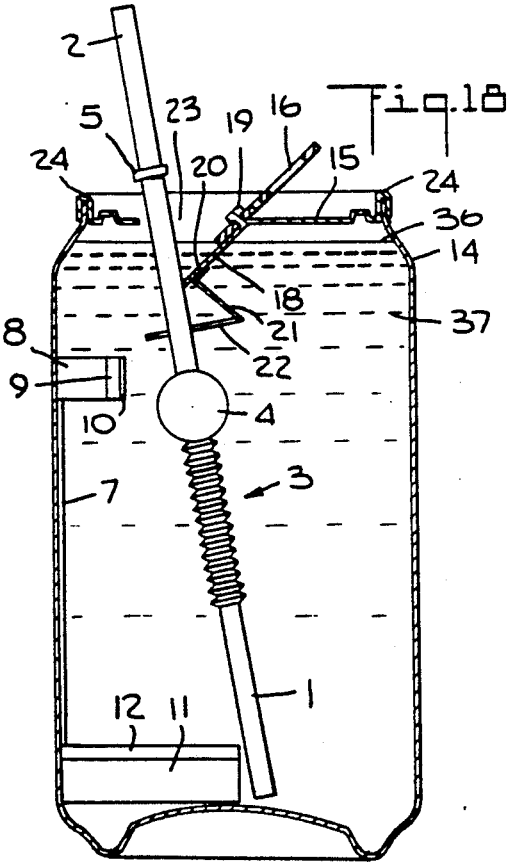

FIG. 18 discloses a straw with its flexible portion 3 straightened to reach the bottom of the can to suck the liquid when the level goes down.

OPERATION—FIGS. 15, 16, 17, 18

Figure 17:
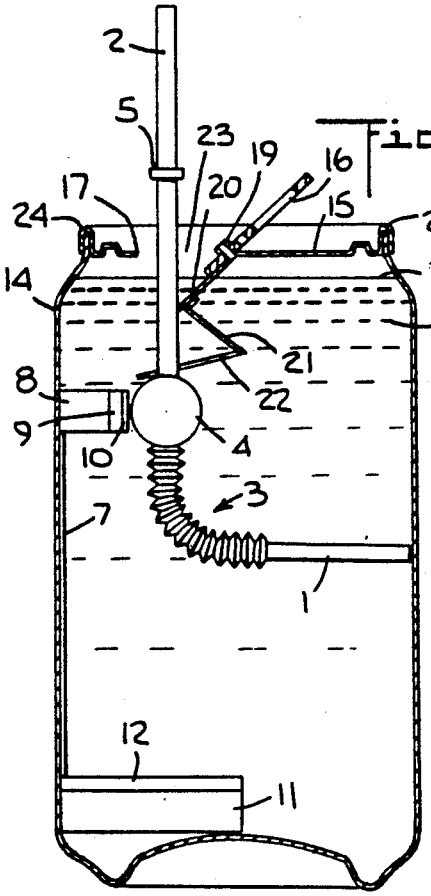

The manner of using the Floating Straw for Beverage Cans is very simple. The consumer will buy the product like the one illustrated in FIG. 15 which is a regular beverage can. All he/she has to do is pull the tab 16 up as with any other beverage can, at that moment tab 18 will be forced by the pull tab 16 and will go inside the can making the straw guide move and detach the straw from hand 9. As the pull tab 16 is pulled up the straw will be guided to the opening slot 23 and will come up immediately to an ideal drinking position as FIG. 17 shows.

While drinking, if the level of the liquid goes down, one can straighten up the straw by pulling the top portion 2 of the straw with his/her lips. Once straightened, the straw will reach the bottom of the can facilitating the suction of the rest of the beverage left on the bottom of the can.

SUMMARY, RAMIFICATIONS, AND SCOPE

Accordingly, the reader will see that the floating straw of this invention provides consumers an easy and convenient way to drink from a beverage can. Furthermore, the Floating Straw for Beverage Cans has the additional advantages in that it permits the consumers to drink beverages without their fingers ever touching the straw;

it provides consumers with a floating straw that comes up to an ideal drinking position every time the pull tab is opened;

it provides a straw holder that is glued or spot welded inside the can that will securely hold the straw even during impacts;

it provides a straw guide that guides the straw accurately to the opening slot.

Although the description above contains many specificaties, these should not be construed as limiting the scope of the invention but as merely providing illustrations of some of the presently preferred embodiments of this invention. For example, the straw guide can have other shapes; oval, etc.

Thus the scope of the invention should be determined by the appended claims, rather than by examples given.

What I claim is:

1. In combination, a beverage can arrangement containing:

(a) a tab that does not separate completely from the can when opened, instead it pivots downwardly and inwardly into a drinking slot of said can, (b) a straw having a flexible portion, a float made of a material of a lesser specific gravity than water and a ring that prevents the straw from floating until the tab is opened, (c) a straw guide attached underneath the tab of said can and having a straw hole fitting the straw, (d) a straw holder having an extended C-shaped clamp that resembles a broom handle holder on a top end of said straw holder and an eaves shaped straw retainer on a bottom end of said straw holder, said straw holder is attached to an inside wall of said can, so that the straw is held vertically adjacent to the inside wall by both the straw holder and the straw guide; when tab is opened and pivots downwardly and inwardly the straw hole detaches the straw from the said clamp and guides it radially inwardly away from the inside wall towards the drinking slot of said can.

* * * * *